US006913157B2

(12) United States Patent
Oh

(10) Patent No.: US 6,913,157 B2
(45) Date of Patent: Jul. 5, 2005

(54) CLOSURE AND CONTAINER AND COMBINATION THEREOF WITH ANTI-BACKOFF MEMBER

(75) Inventor: Jack S. Oh, Buena Park, CA (US)

(73) Assignee: Delta Plastics, Inc., Hot Springs, AR (US)

( * ) Notice: Subject to any disclaimer, the term of this patent is extended or adjusted under 35 U.S.C. 154(b) by 0 days.

(21) Appl. No.: 10/083,001

(22) Filed: Feb. 26, 2002

(65) Prior Publication Data

US 2003/0160020 A1 Aug. 28, 2003

(51) Int. Cl.[7] ..... B65D 41/34
(52) U.S. Cl. ..... 215/330; 215/329; 220/296
(58) Field of Search ..... 215/329, 330, 215/331; 220/293, 296

(56) References Cited

U.S. PATENT DOCUMENTS

| | | | | |
|---|---|---|---|---|
| 3,295,708 A | * | 1/1967 | Wathen, Jr. | 215/330 |
| 3,435,978 A | | 4/1969 | Wittwer | |
| 3,480,170 A | * | 11/1969 | Evans et al. | 215/215 |
| 3,511,403 A | | 5/1970 | Braun | |
| 3,610,454 A | * | 10/1971 | Malick | 215/217 |
| 3,620,400 A | * | 11/1971 | Braun | 215/330 |
| 3,682,345 A | | 8/1972 | Baugh | |
| 3,871,545 A | | 3/1975 | Bereziat | |
| 3,963,139 A | | 6/1976 | Gach | |
| 3,979,001 A | | 9/1976 | Bogert | |
| 4,053,077 A | | 10/1977 | DeFelice | |
| 4,084,716 A | | 4/1978 | Bogert | |
| 4,125,201 A | * | 11/1978 | Birch | 215/330 |
| 4,193,509 A | | 3/1980 | Dunn, Jr. | |
| 4,236,646 A | | 12/1980 | Ganz, Jr. et al. | |
| 4,325,487 A | * | 4/1982 | Libit | 215/330 |
| 4,349,116 A | | 9/1982 | Luenser | |
| 4,461,394 A | | 7/1984 | Sendel et al. | |
| 4,572,387 A | | 2/1986 | Luker et al. | |
| 4,697,715 A | | 10/1987 | Beruvides | |
| 4,736,859 A | | 4/1988 | Mayes et al. | |
| 4,784,817 A | | 11/1988 | Towns et al. | |
| 4,798,303 A | | 1/1989 | Arnold | |
| 4,913,299 A | | 4/1990 | Petro | |
| 5,169,033 A | | 12/1992 | Shay | |
| 5,197,621 A | | 3/1993 | Bartl et al. | |
| 5,271,512 A | | 12/1993 | Ekkert | |
| 5,292,020 A | | 3/1994 | Narin | |
| 5,462,186 A | * | 10/1995 | Ladina et al. | 215/330 |
| 5,494,174 A | | 2/1996 | Rohr et al. | |
| 5,560,505 A | | 10/1996 | Schneider et al. | |
| 5,667,089 A | | 9/1997 | Moore | |
| 5,676,270 A | | 10/1997 | Roberts | |
| 5,685,445 A | | 11/1997 | Dobbs | |
| 5,690,241 A | | 11/1997 | Montgomery | |
| 5,713,479 A | | 2/1998 | Brady | |
| 5,722,545 A | * | 3/1998 | Rinne | 215/44 |
| 5,845,798 A | | 12/1998 | Carrier | |
| 5,884,790 A | | 3/1999 | Seidita | |
| 5,975,322 A | | 11/1999 | Reid | |
| 6,006,930 A | * | 12/1999 | Dreyer et al. | 215/44 |
| 6,056,136 A | | 5/2000 | Taber | |
| 6,095,358 A | | 8/2000 | Marino | |
| 6,123,212 A | | 9/2000 | Russell et al. | |
| 6,227,391 B1 | | 5/2001 | King | |
| 6,296,130 B1 | | 10/2001 | Forsyth et al. | |

FOREIGN PATENT DOCUMENTS

| | | | |
|---|---|---|---|
| JP | 2-282060 | * 11/1990 | 215/330 |

* cited by examiner

*Primary Examiner*—Robin A. Hylton
(74) *Attorney, Agent, or Firm*—Wood, Herron & Evans, LLP

(57) ABSTRACT

A closure and container combination has in which anti-backoff capability the closure includes a top wall and a depending annular skirt having closure threading formed on an inner surface of the skirt. The closure threads mate with threads on the container. One or more anti-backoff members are formed on the inner surface of the skirt and/or the outer surface of the container neck and arranged and configured to frictionally engage the mating threading between the anti-backoff member and the threading to resist movement of the closure once secured onto the neck of the container.

32 Claims, 4 Drawing Sheets

CLOSURE AND CONTAINER AND COMBINATION THEREOF WITH ANTI-BACKOFF MEMBER

FIELD OF THE INVENTION

The present invention relates generally to closures for use with containers and, more particularly, to a threaded closure that resists backing off of the container when the container and closure are in a closed position.

BACKGROUND OF THE INVENTION

In containers using threaded closures where either the container or closure or both are made of a resilient plastic material, slippage or loosening of the closure from the container, normally classified as "backing off", can occur. This backoff effect is typically caused due to several factors. Resilient plastic materials inherently posses the ability to flow or creep under stress or pressure which results in a gradual loosening of the closure on the neck of the container. The closure may loosen from the container due to the internal pressure of the packaged product or pressures involved in air transport of the product. The low co-efficient of friction and self-lubricating qualities of plastic materials normally used in molding typical closures and containers can cause slippage. Minor manufacturing defects that occur during the molding process can create misalignment problems between the closure and the container that lead to backing off. Most commonly, with the above properties vibrations that occur during shipping and handling of the containers can cause the closure to backoff.

Backing off can be a significant problem to packagers in that containers having closures which are loose or appear to have been opened are less likely to be selected by consumers for fear of tampering or contamination. Further, the contents of the container can become spoiled and the product becomes unsalable, which results in a complete loss to the product manufacturer, distributor, or retailer. All in all, the effects of backing off can cost a manufacturing, packaging, distributing or retail business a substantial amount of money.

Thus far, most of the solutions to the costly problem of closure backoff have either failed or are too expensive, too inconvenient or too complicated to work in the closure cap and container manufacturing processes. Some of these solution include the addition of appendages which mate with the container, grooves or recesses, and a system of complementary ridges and recesses. These solutions typically require retooling and redesign of molding dies and stamping machinery, and therefore, are not acceptable to manufacturers. While many of the solutions and other types of closures have proved satisfactory in many respects, nevertheless, there is still a need for a container closure which provides a long term retention of the initial torque used to apply the closure to the container. The present invention provides such a closure assembly which resists subsequent loosening, or backing off, of the closure from the container.

SUMMARY OF THE INVENTION

It is therefore an object of the present invention to have a threaded closure construction which resists loosening during shipment or handling of the filled containers.

It is yet a further object of the present invention to provide a threaded closure assembly having an anti-backoff feature which is economical and easily adaptable to the closure cap and container manufacturing processes.

The present invention overcomes the foregoing and other shortcomings and drawbacks of closures having anti-backoff capability heretofore known. While the invention will be described in connection with certain embodiments, it will be understood that the invention is not limited to these embodiments. On the contrary, the invention includes all alternatives, modifications and equivalents as may be included within the spirit and scope of the claimed invention.

In one embodiment of the invention, a closure includes a top wall and a skirt depending downwardly from the top wall that includes segmented threads for securing the closure to the neck of a bottle, container or the like. An anti-backoff tab that extends generally parallel to the top wall of the closure is included in a region of the closure threading. The anti-backoff tab forms a space between the tab and the next adjacent thread in the same thread segment having a width which is less than the root-to-root width of the threads formed on the bottle or container neck. Further, the anti-backoff tab has an increased depth relative to the depth of the threads in each thread segment.

In use, the threads of the closure are engaged with the threads of the bottle or container neck. As the closure is tightened, the bottle or container threads are frictionally engaged in a reduced space formed by the anti-backoff tab and the next adjacent thread in each thread segment. This frictional engagement between the anti-backoff tab, the closure threads and the next adjacent thread in the thread region provides an anti-backoff capability that reduces the likelihood that the closure will become loosened during transport and handling of the bottle or container, by slippage or by internal container pressure. Moreover, the increased depth of the anti-backoff tab further creates frictional engagement with the neck of the bottle or container to improve the anti-backoff capability of the closure.

In accordance with another aspect of the invention, the closure may include a pair of anti-backoff tabs in the thread region of each thread segment. The anti-backoff tabs extend generally in the direction of the uppermost thread in each thread region but are oriented generally parallel to the top wall of the closure. The pair of anti-backoff tabs in each thread region are provided to frictionally engage longer threads of a bottle or container, but are otherwise structurally and functionally similar to the anti-backoff tab described above.

Alternative embodiments of this invention include anti-backoff tabs in which: (1) the tab depth is equal to or less than that of the thread; (2) the tab is at an angle relative to the top of the closure depending on the slope of the threads; and/or (3) the tab is not integral with the threads.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 2:
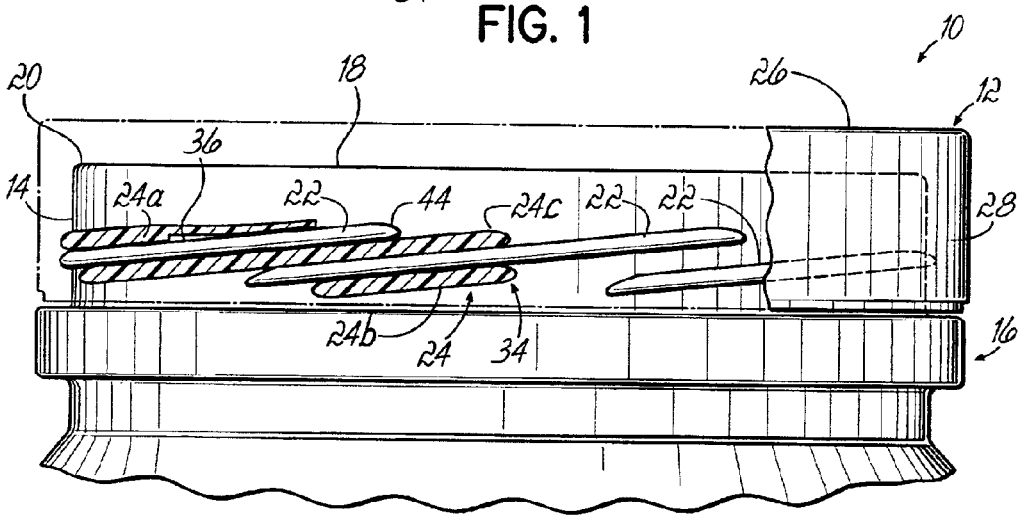
FIG. 2 is an elevational view of a package including a container having a neck portion defining an opening and the closure of FIG. 1 mounted thereto to seal the container.

With reference to the Figures, and to FIG. 2 in particular, a package 10 is shown including a closure 12 mounted onto a neck portion 14 of a container 16 to seal an opening 18 defined by an annular rim 20 of the container 16. One presently preferred embodiment and system for making the closure 12 is disclosed in U.S. Pat. No. 6,099,785, which is hereby incorporated by reference entirely. Container 16 may be manufactured of glass, a thermoplastic material or any other suitable container material, while the closure 12 may be manufactured of a thermoplastic or similar material in accordance with one embodiment of the present invention using a conventional injection molding technique. Container 16 has threading 22 formed about its neck portion 14 that is adapted to threadably engage, in a conventional manner, with threading 24 formed on the closure 12 to prevent upward movement of the closure 12 relative to the container 16 when the closure 12 is threaded upon the neck 14 of the container 16 to seal the opening 18.

The primary focus of the present invention is to provide anti-backoff capability between the mated closure 12 and container 16 as will be described in greater detail below so that the closure 12 resists loosening or backing-off of the container's neck portion 14 once the closure 12 has been firmly tightened onto the container 16 to seal the opening 18. Closure 12 has a top wall 26 which is generally circular in shape and a generally cylindrical or annular skirt 28 depending from the top wall 26. The closure threading 24 is formed on an inner surface 30 of the skirt 28 so that the closure threading 24 is oriented at an angle relative to the top wall 26 of the closure 12 and extends inwardly from the inner surface 30 of the skirt 28 and toward the neck portion 14 of the container 16 when the closure 12 placed in its operative position on the container 16. Closure 12 has a series of circumferentially spaced protuberances 32 formed beneath the top wall 26 and above an uppermost portion 24*a* of the closure threading 24. The protuberances 32 are adapted to retain a liner (not shown) adjacent the top wall 26 as is conventional in the art for forming a seal between the annular rim 20 of the container 16 and the closure 12 when it is firmly secured on the container 16.

Figure 1:
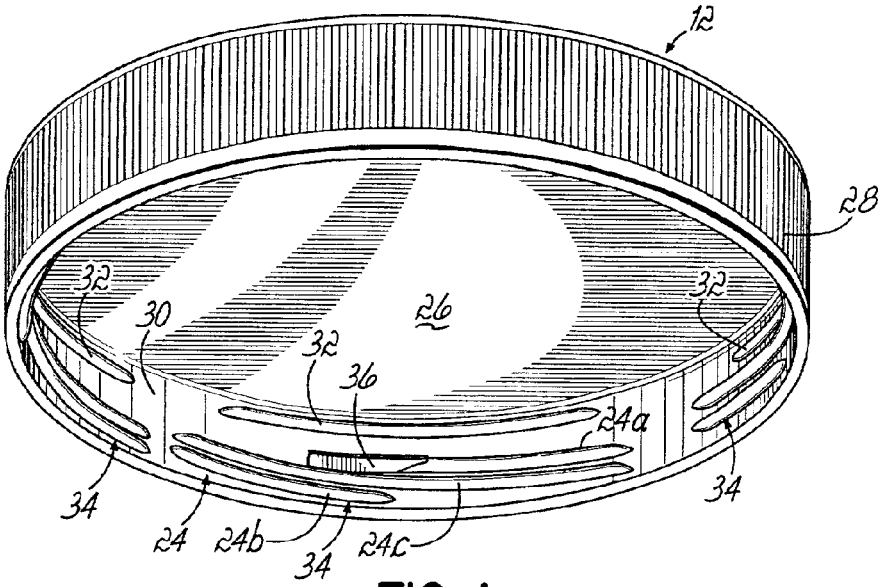
FIG. 1 is a perspective view of a closure having anti-backoff capability in accordance with one embodiment of the present invention.

In one embodiment of the present invention, the closure threading 24 is segmented into a series of circumferentially spaced closure threading groups 34 which are adapted to cooperate with the container threading 22 in a standard manner when the closure 12 is mounted to the neck 14 of the container 16 as shown in FIG. 2. For example, the closure 12 may have four (4) circumferentially spaced groups 34 of closure threading 24 formed on the inner surface 30 of the skirt 28 as shown in FIG. 1 to threadably cooperate in standard manner with the container threading 22.

While segmented closure threading 24 is shown on the inner surface 30 of the closure 12, it will be appreciated that closure threading 24 may take many different forms, such as a continuous single helical thread (not shown) or other thread forms well known to those of ordinary skill in the art, without departing from the spirit and scope of the present invention. The present invention is not therefore limited to the segmented closure threading 24 shown, but rather contemplates any conventional closure threading known in the art for threadably engaging the closure 12 to conventional container threading 22.

In accordance with one embodiment of the present invention, as shown in FIGS. 1, 2, 3A–3D and 5A–5B, one or more anti-backoff members 36, which may each take the form of a flexible or resilient tab-like structure as shown, are formed on the inner surface 30 of the closure skirt 28. As will be described in greater detail below, the anti-backing members 36 are provided to increase the removal torque required to unscrew the closure 12 from the neck 14 of the container 16. The anti-backoff members 36 increase the frictional engagement between the closure 12 and the container 16 to reduce the likelihood that the closure 12 will become loosened during transport and handling of the container 16, by slippage or by internal container pressure.

Further referring to FIGS. 1, 2, 3A–3D and 5A–5B, each anti-backoff member 36 may be integrally connected along its entire length with the inner surface 30 of the closure skirt 28 and extend inwardly from the skirt 28 in a generally common direction with the closure threading 24. In one embodiment of the present invention, each closure threading group 34 has at least one anti-backing member 36 associated therewith that is formed generally in a region 38 (FIGS. 3A and 5A–5B) of the closure threading 24 as defined by the uppermost portion 24*a* and the lowermost portion 24*b* of the closure threading 24. Each anti-backoff member 36 is arranged and configured to frictionally engage the container threading 22 between the anti-backoff member 36 and the closure threading 24 (FIGS. 5A–5B) to resist opening movement of the closure 12 once secured onto the neck 14 of the container 16 as will be described in detail below in connection with FIGS. 3B–3D.

As shown in FIGS. 1 and 3A–3D, the anti-backoff members 36 may form an integral extension of a portion of the closure threading 24, such as an integral extension of the uppermost portion 24*a* of the closure threading 24 as shown, and extend in a circumferential direction about the skirt 28. Each anti-backoff member 36 may be oriented generally parallel with the top wall 26 of the closure 12 to form a space 40 (FIG. 3A) between the anti-backoff member 36 and the next adjacent thread portion 24*c* in the same closure threading group 34. Alternatively, the anti-backoff member 36 may be angled or sloped relative to the top wall 26 and/or be spaced from the closure threading 24.

In accordance with the principles of the present invention, each space 40 formed by the anti-backoff members 36 and the next adjacent thread portion 24*c* in the same closure threading group 34 has a width which is less than the root-to-root width of the container threading 22 so that as the closure 12 is tightened about the neck 14 of the container 16, the container threading 22 is frictionally engaged in the reduced spaces 40. This frictional engagement between the anti-backoff members 36, the container threading 22 and the next adjacent thread portion 24*c* in each closure threading group 34 provides the advantageous anti-backoff capability of the closure 12 (FIGS. 5A–5B).

In one embodiment of the present invention, the anti-backoff members 36 extend in a circumferential direction from a trailing end 42 (FIG. 3A) of the closure threading 24. In this way, the increased frictional engagement between the closure 12 and the container neck 14 does not occur until the closure 12 has been almost fully screwed onto the neck 14 of the container 16. In other contemplated embodiments of the present invention, the anti-backoff members 36 may extend in a circumferential direction from more forward or leading portions of the closure threading 24 without departing from the spirit and scope of the present invention.

It is further contemplated in an alternative embodiment that the anti-backoff members 36 may extend in a circumferential direction from any portion of the closure threading 24 between the uppermost portion 24*a* and the lowermost portion 24*b* of the closure threading 24 without departing from the spirit or scope of the present invention. While each of the anti-backoff members 36 may form an integral extension of the closure threading 24, it is contemplated in an alternative embodiment of the present invention that the anti-backoff members 36 may be formed on the inner surface 30 of the skirt 28 spaced from but adjacent to the closure threading 24 without departing from the spirit and scope of the present invention. Moreover, while each of the anti-backoff members 36 is shown as comprising a continuous or elongated member, it is contemplated in an alternative embodiment of the present invention that each anti-backoff member 36 may be formed as a series of spaced protuberances extending inwardly from the inner surface 30 of the skirt 28 without departing from the spirit and scope of the present invention. Additionally, while each anti-backoff member 36 is shown integrally connected along its entire length with the inner surface 30 of the closure skirt 18, it is contemplated in an alternative embodiment that a portion of each anti-backoff member 36 may be detached from the inner surface 30 of the skirt 28 so as to be deflectable in an axial direction relative to another portion of the anti-backoff member 36.

Figure 5A:
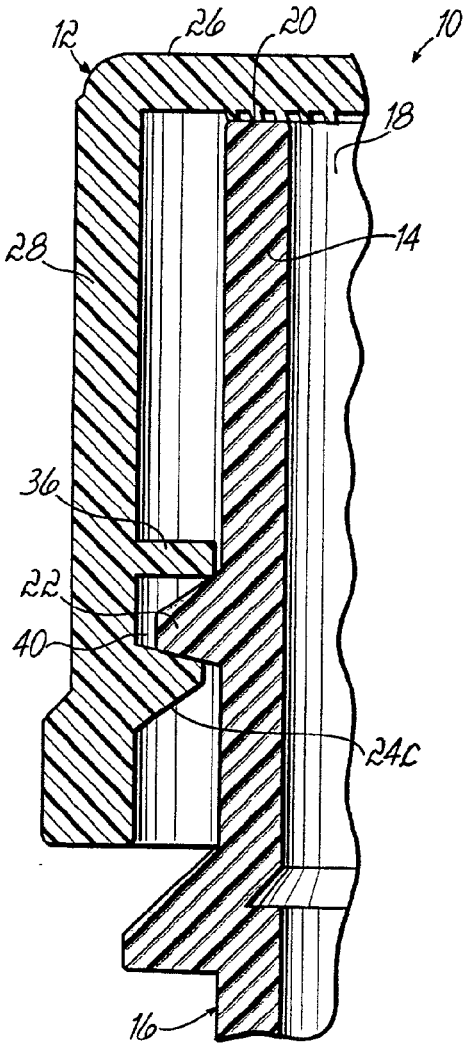
FIGS. 5A and 5B are each a cross-sectional view taken along line 5—5 of FIG. 3A sequentially showing the deflection of an anti-backoff tab.
Figure 5B:
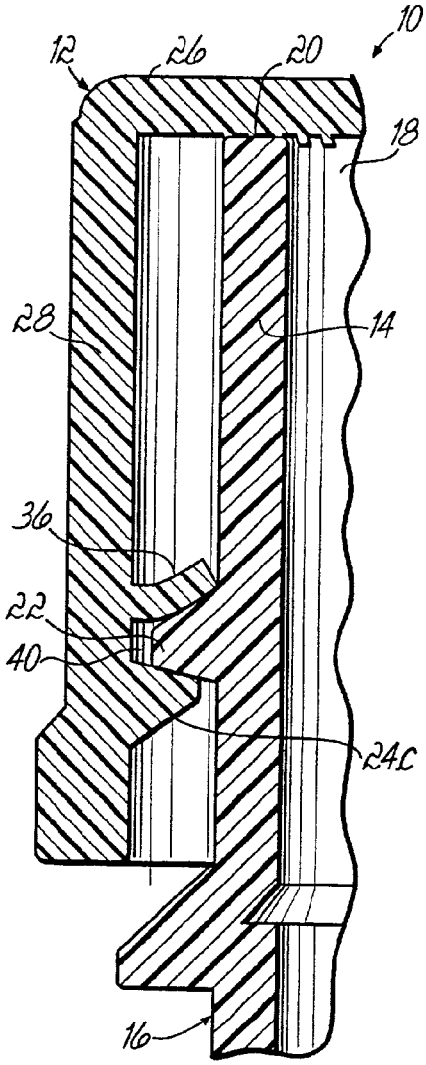

In accordance with another aspect of the present invention, as shown in FIGS. 1 and 5A–5B, each of the anti-backoff members 36 may have a depth relative to the inner surface 30 of the skirt 28 that exceeds the depth of the closure threading 24 relative to the inner surface 30 of the skirt 28. The increased depth of the anti-backoff members 36 further increases the frictional engagement of the closure 12 with the neck 14 of the container 16 to enhance the anti-backoff capability of the closure 12.

Figure 3A:
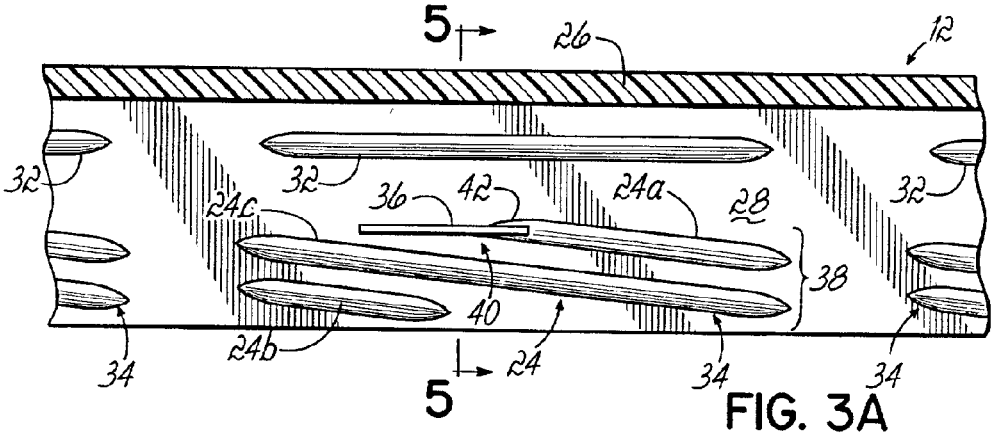
FIG. 3A is a developed view of the closure of FIG. 1.
Figure 3B:
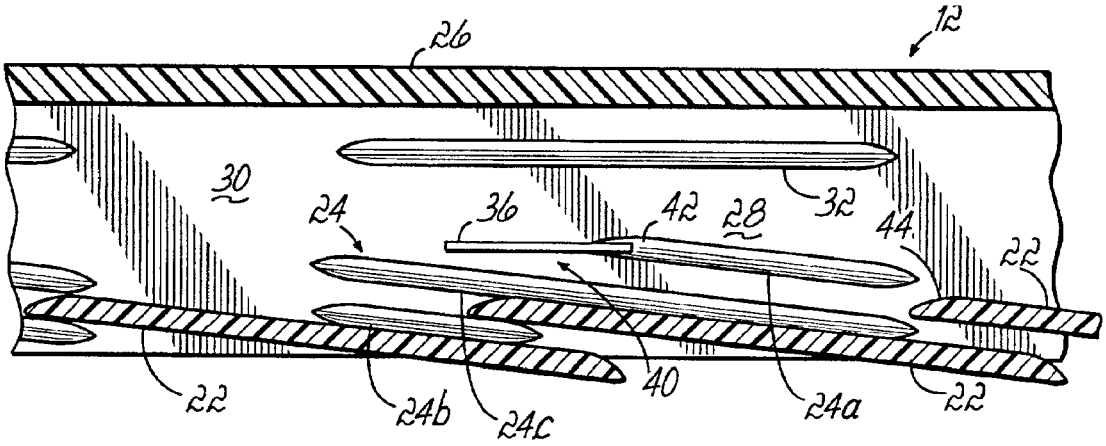
FIG. 3B is a developed view illustrating initial mounting of the closure of FIG. 1 onto the neck portion of the container.
Figure 3C:
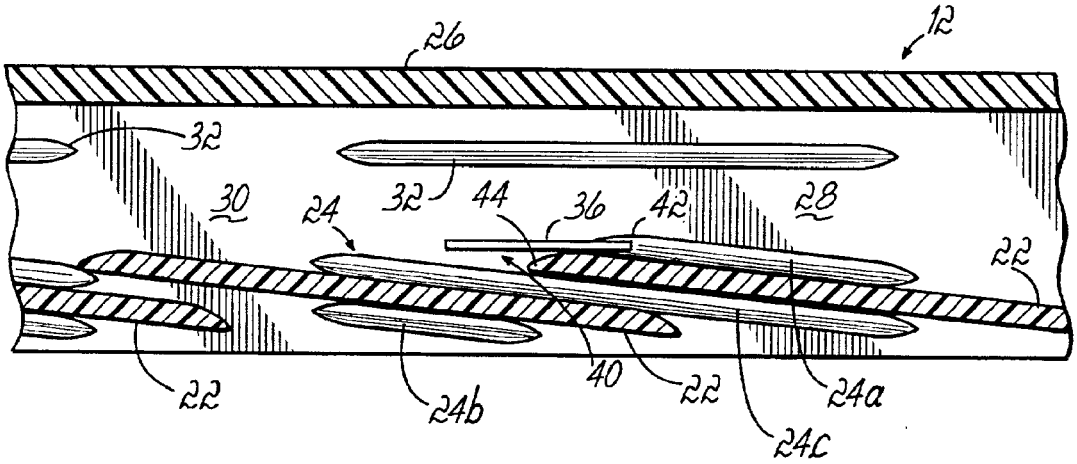
FIG. 3C is a view similar to FIG. 3B illustrating further mounting of the closure of FIG. 1 onto the neck portion of the container to seal the container.
Figure 3D:
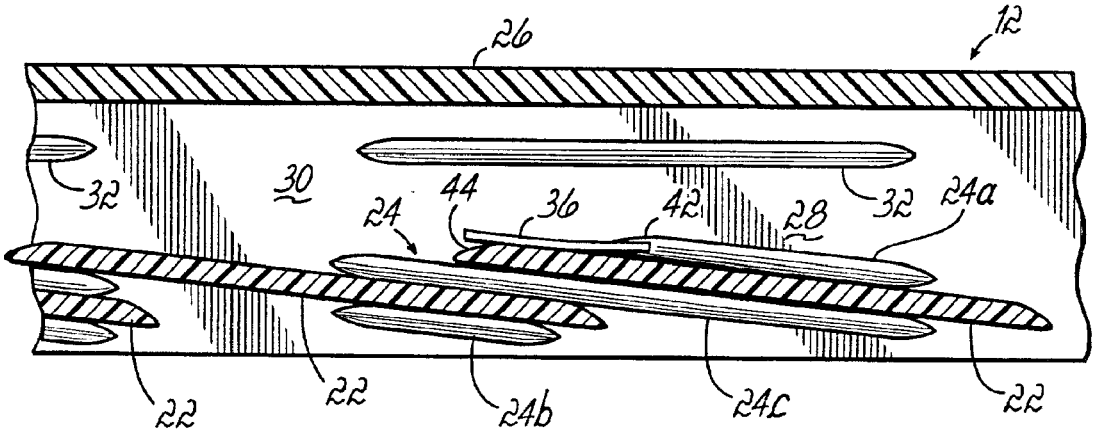
FIG. 3D is a view similar to FIG. 3B illustrating the enclosure of FIG. 1 fully mounted onto the neck portion of the container in a sealed position.

In use, and as shown in FIGS. 1 and 3B–3D, the closure 12 is initially screwed onto the neck portion 14 of the container 16 so that the closure threads 24 and container threads 22 threadably engage each other in a conventional manner as shown in FIG. 3B. As the closure 12 is further screwed onto the container 16, a leading edge 44 of the container threading 22 enters the space 40 formed between the anti-backoff members 36 and the next adjacent closure threading 24*c* as shown in FIG. 3C. As the closure 12 is then tightened on the container 16 to seal the opening 18 as shown in FIG. 3D, the anti-backoff members 36 frictionally engage the container threading 22 between the anti-backoff members 36 and the closure threading 24 to resist opening movement of the closure 12 in accordance with the principles of the present invention. The anti-backoff members 36 may bend or deflect upon engagement with the threads 22 as shown in FIG. 5B.

Figure 4:
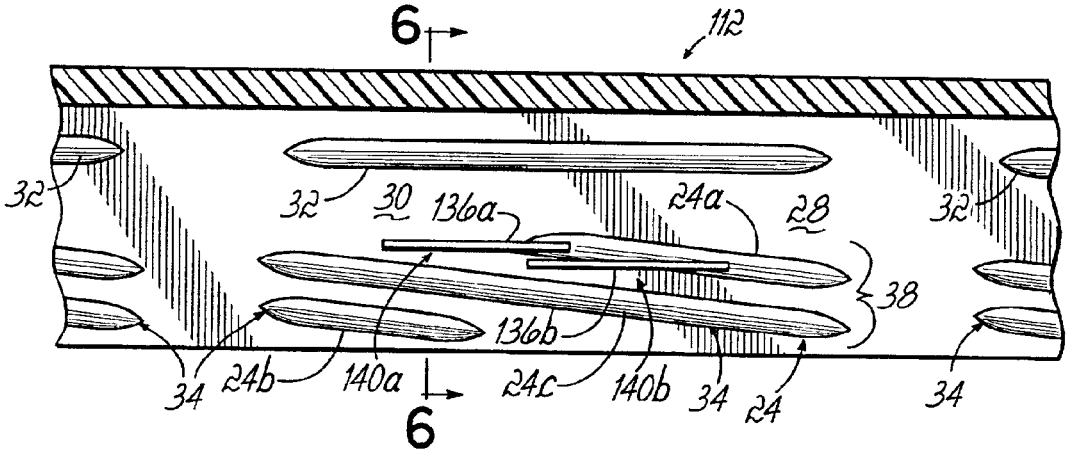
FIG. 4 is a developed view of a closure having anti-backoff capability in accordance with an alternative embodiment of the present invention.
Figure 6:
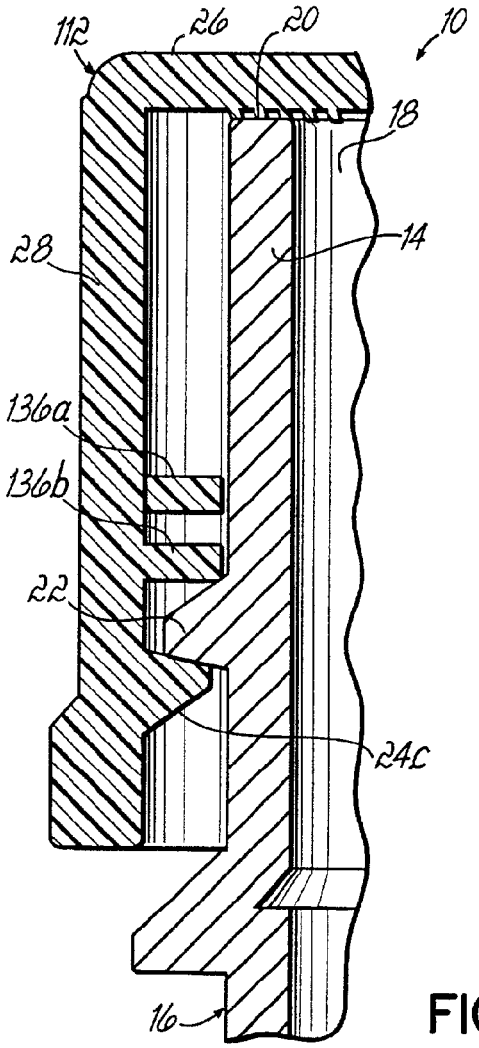
FIG. 6 is a cross-sectional view taken along line 6—6 of FIG. 4.

Referring now to FIGS. 4 and 6, a closure 112 in accordance with an alternative embodiment of the present invention is shown where like numerals represent like parts to the closure 12 of FIGS. 1, 2, 3A–3D and 5A–5B. In this embodiment, at least one of the closure threading groups 34 has a pair of anti-backoff members 136*a* and 136*b* associated therewith formed generally in the region 38 of the closure threading 24. In one embodiment, the pair of anti-backoff members 136*a* and 136*b* may form integral extensions of the closure threading 24, such as integral extensions of the uppermost portion 24*a* of the closure threading 24 as shown, and extend in a circumferential direction about the skirt 28. Each anti-backoff member 136*a* and 136*b* may be oriented generally parallel with the top wall 26 of the closure 112 to form a pair of spaces 140*a* and 140*b* (FIG. 4) between the anti-backoff members 136*a*, 136*b* and the next adjacent thread portion 24*c* in the same closure threading group 34.

Each of the spaces 140*a* and 140*b* formed by the pair of anti-backoff members 136*a*, 136*b* and the next adjacent thread portion 24*c* in the same closure threading group 34 has a width which is less than the root-to-root width of the container threading 22 so that as the closure 112 is tightened about the neck 14 of the container 16, the container threading 22 is frictionally engaged in the reduced spaces 140*a* and 140*b* to provide the advantageous anti-backoff capability of the closure 112 as described in detail above in connection with closure 12. The pair of anti-backoff members 136*a*, 136*b* may be provided in each container threading group 34 when additional frictional engagement between the closure 112 and the container 16 is desired to resist opening movement of the closure 112 once secured onto the neck 14 of the container 16. Of course, other orientations of the anti-backoff members 136*a* and 136*b* in the region 38 of the closure threading 24 are possible as well without departing from the spirit and scope of the present invention. Additional modifications will be readily appreciated by those of ordinary skill in the art.

In accordance with another aspect of the present invention, as shown in FIG. 6, each of the anti-backoff members 136*a* and 136*b* may have a depth relative to the inner surface 30 of the skirt 28 that exceeds the depth of the closure threading 24 relative to the inner surface 30 of the skirt 28. The increased depth of the anti-backoff members 136*a* and 136*b* further increases the frictional engagement of the closure 112 with the neck 14 of the container 16 to enhance the anti-backoff capability of the closure 112.

Figure 7:
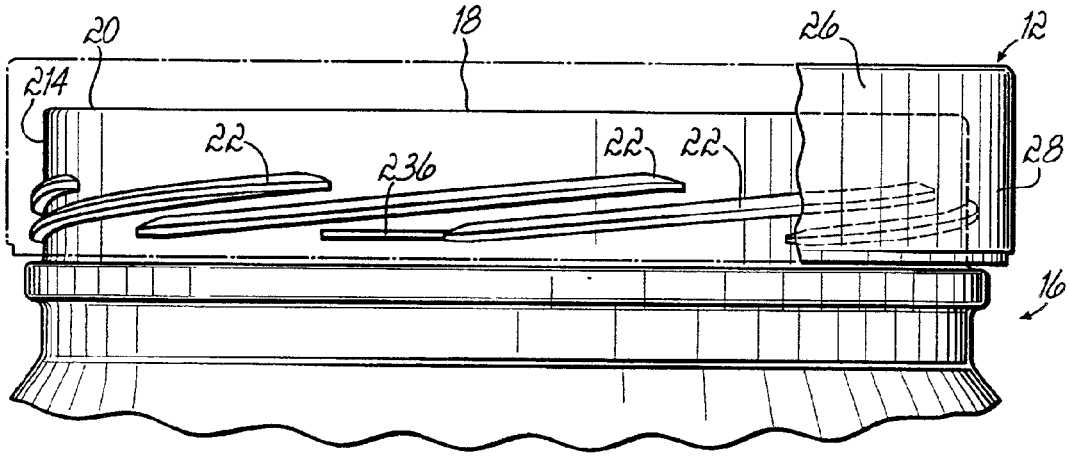
FIG. 7 is an elevational view of an alternative embodiment of this invention in which the container includes anti-backoff capability.

In a still further embodiment of this invention as shown in FIG. 7, anti-backoff members 236 are included on the neck 214 of the container 16. The anti-backoff member 236 is formed integrally with the neck 214 and is shown generally parallel to the opening 18 although it may be angled or sloped and extend to a depth the same as, greater or less than the threads 22. The anti-backoff member 236 engages the threads 24 on the closure 12 when the closure 12 and container 16 are threadably mated together.

It will be appreciated by those of ordinary skill in the art that the closures 12 and 112 of the present invention reduce the likelihood that the closures 12 and 112 will become loosened during transport and handling of the container 16, by slippage or by internal container pressure. The anti-backoff members 36 of closure 12, the pair of anti-backoff members 136*a*, 136*b* of closure 112, and the anti-backoff members 236 of the container 16 increase the frictional engagement between the closures 12, 112 and the container 16 to thereby increase the removal torque required to unscrew the closures 12, 112 from the neck 14 of the container 16.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

Having described the invention, what is claimed is:

1. A closure for use with a container having a neck portion and container threading formed thereon, comprising:

a top wall;

an annular skirt depending from the top wall and having closure threading formed on an inner surface thereof configured and arranged to threadably engage the container threading; and at least one flexible anti-backoff member extending circumferentially on the skirt in a region of the closure threading and being arranged and configured to deflect and frictionally engage the container threading between the anti-backoff member and the closure threading to resist movement of the closure once secured onto the neck of the container;

wherein a lead angle of the at least one anti-backoff member is different from a lead angle of the closure threading;

wherein the at least one anti-backoff member forms an integral extension of a portion of the closure threading.

2. The closure of claim 1 wherein a width of the at least one anti-backoff member is greater than a thickness thereof, the width being measured generally perpendicular to the skirt from a root of the anti-backoff member adjacent to the skirt to a distal end of the anti-backoff member and the thickness being measured at the root of the anti-backoff member generally parallel to the skirt.

3. The closure of claim 1 wherein the at least one anti-backoff member is oriented generally parallel to the top wall of the closure.

4. The closure of claim 1, wherein the at least one anti-backoff member forms an integral extension of an uppermost portion of the closure threading.

5. A closure for use with a container having a neck portion and container threading formed thereon, comprising:

a top wall;

an annular skirt depending from the top wall and having closure threading formed on an inner surface thereof configured and arranged to threadably engage the container threading; and at least one anti-backoff member extending circumferentially on the skirt in a region of the closure threading and being arranged and configured to frictionally engage the container threading between the anti-backoff member and the closure threading to resist movement of the closure once secured onto the neck of the container;

wherein an angular inclination of the at least one anti-backoff member is different from an angular inclination of the closure threading, and the at least one anti-backoff member forms an integral extension of an uppermost portion of the closure threading and is oriented generally parallel to the top wall of the closure.

6. The closure of claim 1, wherein the closure threading is segmented into a plurality of circumferentially spaced closure threading groups, and wherein at least one of the closure threading groups has the at least one anti-backoff member associated therewith.

7. The closure of claim 6, wherein the at least one anti-backoff member forms an integral extension of a portion of the closure threading in at least one of the closure threading groups.

8. The closure of claim 7, wherein the at least one anti-backoff member is oriented generally parallel to the top wall of the closure.

9. The closure of claim 6, wherein the at least one anti-backoff member forms an integral extension of an uppermost portion of the closure threading in at least one of the closure threading groups.

10. The closure of claim 9, wherein the at least one anti-backoff member is oriented generally parallel to the top wall of the closure.

11. The closure of claim 1, wherein the at least one anti-backoff member has a depth relative to an inner surface of the annular skirt that exceeds a depth of the closure threading relative to the inner surface of the annular skirt.

12. A closure for use with a container having a neck portion and container threading formed thereon, comprising:

a top wall;

an annular skirt depending from the top wall and having closure threading formed on an inner surface thereof configured and arranged to threadably engage the container threading, the closure threading being segmented into a plurality of circumferentially spaced closure threading groups;

a plurality of anti-backoff members each formed in a region of the closure threading in at least one of the closure threading groups, extending circumferentially on the skirt and being arranged and configured to frictionally engage the container threading between the anti-backoff member and the closure threading to resist movement of the closure once secured onto the neck of the container;

wherein an angular inclination of the at least one anti-backoff member is different from an angular inclination of the closure threading.

13. The closure of claim 12, wherein the plurality of anti-backoff members form integral extensions of a portion of the closure threading in at least one of the closure threading groups.

14. The closure of claim 13, wherein the plurality of anti-backoff members are oriented generally parallel to the top wall of the closure.

15. The closure of claim 12, wherein the plurality of anti-backoff members form integral extensions of an uppermost portion of the closure threading in at least one of the closure threading groups.

16. The closure of claim 15, wherein the plurality of anti-backoff members are oriented generally parallel to the top wall of the closure.

17. A closure for use with a container having a neck portion and container threading formed thereon, comprising:

a top wall;

an annular skirt depending from the top wall and having closure threading formed on an inner surface thereof configured and arranged to threadably engage the container threading; and a plurality of anti-backoff members formed in a region of the closure threading and being arranged and configured to frictionally engage the container threading between the anti-backoff member and the closure threading to resist movement of the closure once secured onto the neck of the container;

wherein the closure threading is segmented into a plurality of circumferentially spaced closure threading groups, and wherein at least one of the closure threading groups has at least one of the anti-backoff members associated therewith;

wherein the plurality of anti-backoff members are formed in a region of the closure threading in at least one of the closure threading groups;

wherein each of the plurality of anti-backoff members has a depth relative to an inner surface of the annular skirt that exceeds a depth of the closure threading relative to the inner surface of the annular skirt.

18. A closure for use with a container having a neck portion and container threading formed thereon, comprising:

a top wall;

an annular skirt depending from the top wall and having closure threading formed on an inner surface thereof configured and arranged to threadably engage the container threading; and at least one anti-backoff member formed as an integral extension of a portion of the closure threading and extending in a circumferential direction about the annular skirt, the at least one anti-backoff member being arranged and configured to frictionally engage the container threading in an axial direction on the skirt between the anti-backoff member and the closure threading to resist movement of the closure once secured onto the neck of the container;

wherein a lead angle of the at least one anti-backoff member is different from a lead angle of the closure threading.

19. A closure for use with a container having a neck portion and container threading formed thereon, comprising:

a top wall;

an annular skirt depending from the top wall and having closure threading formed on an inner surface thereof configured and arranged to threadably engage the container threading; and at least one anti-backoff member formed as an integral extension of a portion of the closure threading and extending in a circumferential direction about the annular skirt, the at least one anti-backoff member being arranged and configured to frictionally engage the container threading in an axial direction on the skirt between the anti-backoff member and the closure threading to resist movement of the closure once secured onto the neck of the container;

wherein the at least one anti-backoff member is oriented generally parallel to the top wall of the closure.

20. The closure of claim 18, wherein the closure threading is segmented into a plurality of circumferentially spaced closure threading groups, and wherein at least one of the closure threading groups has at least one of the anti-backoff members associated therewith.

21. The closure of claim 20, wherein the at least one anti-backoff member forms an integral extension of a portion of the closure threading in at least one of the closure threading groups and extends in a circumferential direction about the annular skirt.

22. The closure of claim 21, wherein the at least one anti-backoff member is oriented generally parallel to the top wall of the closure.

23. A closure for use with a container having a neck portion and container threading formed thereon, comprising:

a top wall;

an annular skirt depending from the top wall and having closure threading formed on an inner surface thereof configured and arranged to threadably engage the container threading; and at least one anti-backoff member formed as an integral extension of a portion of the closure threading and extending in a circumferential direction about the annular skirt, the at least one anti-backoff member being arranged and configured to frictionally engage the container threading between the anti-backoff member and the closure threading to resist movement of the closure once secured onto the neck of the container;

wherein the at least one anti-backoff member has a depth relative to an inner surface of the annular skirt that exceeds a depth of the closure threading relative to the inner surface of the annular skirt;

wherein a lead angle of the at least one anti-backoff member is different from a lead angle of the closure threading.

24. The closure of claim 20 further comprising a plurality of anti-backoff members formed in at least one of the closure threading groups.

25. The closure of claim 24, wherein the plurality of anti-backoff members are oriented generally parallel to the top wall of the closure.

26. A closure for use with a container having a neck portion and container threading formed thereon, comprising:

a top wall;

an annular skirt depending from the top wall and having closure threading formed on an inner surface thereof configured and arranged to threadably engage the container threading; and a plurality of anti-backoff member search formed as an integral extension of a portion of the closure threading and extending in a circumferential direction about the annular skirt, each anti-backoff member being arranged and configured to frictionally engage the container threading between the anti-backoff member and the closure threading to resist movement of the closure once secured onto the neck of the container;

wherein the closure threading is segmented into a plurality of circumferentially spaced closure threading groups, and wherein at least one of the closure threading groups has at least one of the anti-backoff members associated therewith;

wherein each of the plurality of anti-backoff members has a depth relative to an inner surface of the annular skirt that exceeds a depth of the closure threading relative to the inner surface of the annular skirt;

wherein a lead angle of each of the anti-backoff members is different from a lead angle of the closure threading.

27. A closure and container assembly, comprising:

a container having a neck portion and container threading formed thereon;

a closure having a top wall, an annular skirt depending from the top wall and having closure threading formed on an inner surface thereof configured and arranged to threadably engage the container threading; and at least one anti-backoff member formed as an integral extension of a portion of the closure threading and extending in a circumferential direction about the annular skirt, the at least one anti-backoff member being arranged and configured to frictionally engage the container threading in an axial direction on the skirt between the anti-backoff member and the closure threading to resist movement of the closure once secured onto the neck of the container;

wherein a lead angle of the at least one anti-backoff member is different from a lead angle of the closure threading.

28. The assembly of claim 27 wherein a width of the at least one anti-backoff member is greater than a thickness thereof, the width being measured generally perpendicular to the skirt from a root of the anti-backoff member adjacent to the skirt to a distal end of the anti-backoff member and the thickness being measured at the root of the anti-backoff member generally parallel to the skirt.

29. The assembly of claim 27 wherein the anti-backoff member is formed on the neck portion of the container and the thickness of the anti-backoff member is generally constant.

30. The assembly of claim 27 wherein the anti-backoff member is formed on the annular skirt of the closure and the thickness of the anti-backoff member is generally constant.

31. The combination of claim 27 wherein the at least one anti-backoff member is generally planar and oriented generally parallel to the top wall when the closure is secured onto the neck of the container.

32. The assembly of claim 27 wherein the at least one anti-backoff member is flexible and deflects when engaged with the container threading.

* * * * *

UNITED STATES PATENT AND TRADEMARK OFFICE

CERTIFICATE OF CORRECTION

PATENT NO. : 6,913,157 B2
DATED : July 5, 2005
INVENTOR(S) : Jack S. Oh

It is certified that error appears in the above-identified patent and that said Letters Patent is hereby corrected as shown below:

Column 10,
Line 34, "member search formed" should read -- members each formed --.

Signed and Sealed this

Thirteenth Day of December, 2005

JON W. DUDAS
*Director of the United States Patent and Trademark Office*